US008602922B2

(12) United States Patent
Schwenger et al.

(10) Patent No.: US 8,602,922 B2
(45) Date of Patent: Dec. 10, 2013

(54) METHODS AND APPARATUSES FOR ENHANCING PERFORMANCE IN RACKET SPORTS

(75) Inventors: Ralf Schwenger, Weiler im Allgäu (DE); Johan Kotze, Wolfurt (AT); Herfried Lammer, St. Veit (AT)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 12/923,537

(22) Filed: Sep. 27, 2010

(65) Prior Publication Data

US 2011/0183787 A1 Jul. 28, 2011

Related U.S. Application Data

(60) Provisional application No. 61/246,034, filed on Sep. 25, 2009.

(51) Int. Cl.
*A63B 49/08* (2006.01)

(52) U.S. Cl.
USPC ..... 473/549; 473/553

(58) Field of Classification Search
USPC ..... 473/459, 461, 524, 549, 553, 221, 222
See application file for complete search history.

(56) References Cited

U.S. PATENT DOCUMENTS

| | | | | |
|---|---|---|---|---|
| 2,121,289 | A | 6/1938 | Gleadall | |
| 4,545,584 | A | 10/1985 | Adam | |
| 4,822,042 | A * | 4/1989 | Landsman | 473/463 |
| 4,870,868 | A | 10/1989 | Gastgeb et al. | |
| 4,991,850 | A | 2/1991 | Wilhlem | |
| 5,031,909 | A | 7/1991 | Pecker | |
| 5,372,365 | A | 12/1994 | McTeigue et al. | |
| 5,757,266 | A | 5/1998 | Rider et al. | |
| 6,527,655 | B2 | 3/2003 | Sims et al. | |
| 2002/0004422 | A1 * | 1/2002 | Tosaki et al. | 463/37 |
| 2005/0170919 | A1 | 8/2005 | Schwenger et al. | |
| 2005/0192129 | A1 | 9/2005 | Kuwabara | |
| 2005/0197198 | A1 * | 9/2005 | Otten et al. | 473/221 |
| 2005/0261073 | A1 * | 11/2005 | Farrington et al. | 473/221 |
| 2006/0276256 | A1 * | 12/2006 | Storek | 473/221 |
| 2007/0105664 | A1 * | 5/2007 | Scheinert et al. | 473/461 |

(Continued)

FOREIGN PATENT DOCUMENTS

| | | |
|---|---|---|
| BE | 1 011 942 A6 | 3/2000 |
| CN | 200960379 | 10/2007 |

(Continued)

OTHER PUBLICATIONS

PCT Invitation to pay Additional Fees with Partial Search Report for PCT/IB2010/002664, mailed Mar. 28, 2011.

(Continued)

*Primary Examiner* — Raleigh W Chiu
(74) *Attorney, Agent, or Firm* — Bookoff McAndrews, PLLC

(57) ABSTRACT

A racket assembly may include a racket, and at least one sensor operatively coupled to the racket. The at least one sensor may be configured to generate a signal indicative of at least one parameter related to use of the racket. The racket assembly may also include a processor configured to receive the signal as an input and generate an output based on the signal.

30 Claims, 19 Drawing Sheets

(56) References Cited

U.S. PATENT DOCUMENTS

| | | | | |
|---|---|---|---|---|
| 2008/0163697 | A1 | 7/2008 | Silpachai et al. | |
| 2008/0200287 | A1* | 8/2008 | Marty et al. | 473/459 |
| 2010/0279800 | A1* | 11/2010 | Zuger | 473/459 |
| 2011/0183787 | A1* | 7/2011 | Schwenger et al. | 473/553 |
| 2012/0004055 | A1* | 1/2012 | Balasubramanyan | 473/459 |

FOREIGN PATENT DOCUMENTS

| | | | |
|---|---|---|---|
| DE | 3436218 | A1 | 4/1985 |
| RU | 2 313 380 | C1 | 12/2007 |
| WO | WO 2011/012576 | A1 | 2/2011 |

OTHER PUBLICATIONS

PCT International Search Report for PCT/1B2010/002664, mailed Oct. 6, 2011.

PCT International Preliminary Report on Patentability for PCT/IB2010/002664, mailed Mar. 27, 2012.

* cited by examiner

74

METHODS AND APPARATUSES FOR ENHANCING PERFORMANCE IN RACKET SPORTS

This application claims priority under 35 U.S.C. §119 based on U.S. Provisional Application No. 61/246,034, filed Sep. 25, 2009, the complete disclosure of which is incorporated herein by reference.

TECHNICAL FIELD

The present disclosure relates to racket sports, and more particularly to enhancing performance in racket sports.

BACKGROUND

In the sporting world, players continually strive to improve their performance. In some sports it may be easy for a player to get feedback about his or her performance through measurement and analysis of movements. In racket sports, however, like tennis, table tennis, platform tennis, racketball, squash, badminton, and/or any other racket sports, it may be more difficult for a player to receive feedback about his or her performance. One reason for the difficulty is that there may be two or more players moving about within given boundaries during play, and their movements may make it difficult to collect data and analyze performance. Another reason is that playing racket sports requires using many kinds of strokes, and data collection and analysis for one type of stroke may be different than data collection and analysis for another type of stroke. Moreover, during play, rallies may be taking place, giving a player little time to think about his or her last stroke, or to analyze his or her swing style, footwork, point of impact, and/or any other parameters. While attempts have been made to incorporate certain measuring devices in sports implements, such devices are limited in terms of their function, and thus, are limited in their appeal to players.

Furthermore, in racket sports, a player's performance may depend on multiple parameters. Examples of performance parameters include the player's skill level, the player's playing style, the player's fitness level, the weather or conditions during which a game is played, and how the opponent plays during a game. Sometimes the player may be in an offensive situation, requiring a powerful racket. Other times, the player may be in a defensive situation, requiring a maneuverable racket. While attempts have been made to provide devices for altering the properties of a racket so that the racket can be adapted to different players, skill levels, opponents, environmental conditions, and/or other situations that may be encountered, such devices may be difficult to manipulate during play, may often times lack durability, and/or may produce rattling or other distracting sounds.

It is accordingly an objective of the present disclosure to provide methods and apparatuses for addressing at least some of the above-described deficiencies or other deficiencies in the art.

SUMMARY

In accordance with an aspect of the present disclosure, a racket assembly may include a racket, and at least one sensor operatively coupled to the racket. The at least one sensor may be configured to generate a signal indicative of at least one parameter related to use of the racket. The racket assembly may also include a processor configured to receive the signal as an input and generate an output based on the signal.

In accordance with another aspect of the present disclosure, a racket assembly may include a racket, an energy supply, and a powered device operatively coupled to the energy supply. The powered device may be configured to alter at least one property of the racket using power from the energy supply.

In accordance with yet another aspect of the present disclosure, a method of enhancing performance in racket sports may include collecting racket data during use of a racket using at least one sensor assembly operatively coupled to the racket. The method may also include analyzing the racket data and determining one or more values based on the racket data using a processor operatively coupled to the at least one sensor assembly. The method may further include conveying at least one of the racket data and the one more values to a user of the racket through a feedback system.

Additional objects and advantages of the disclosure will be set forth in part in the description which follows, and in part will be obvious from the description, or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles of the disclosure.

DESCRIPTION OF THE EMBODIMENTS

Reference will now be made in detail to embodiments of the present disclosure, examples of which are illustrated in the accompanying drawings. Wherever possible, the same reference words or phrases will be used throughout the drawings to refer to the same or like parts.

Figure 1:
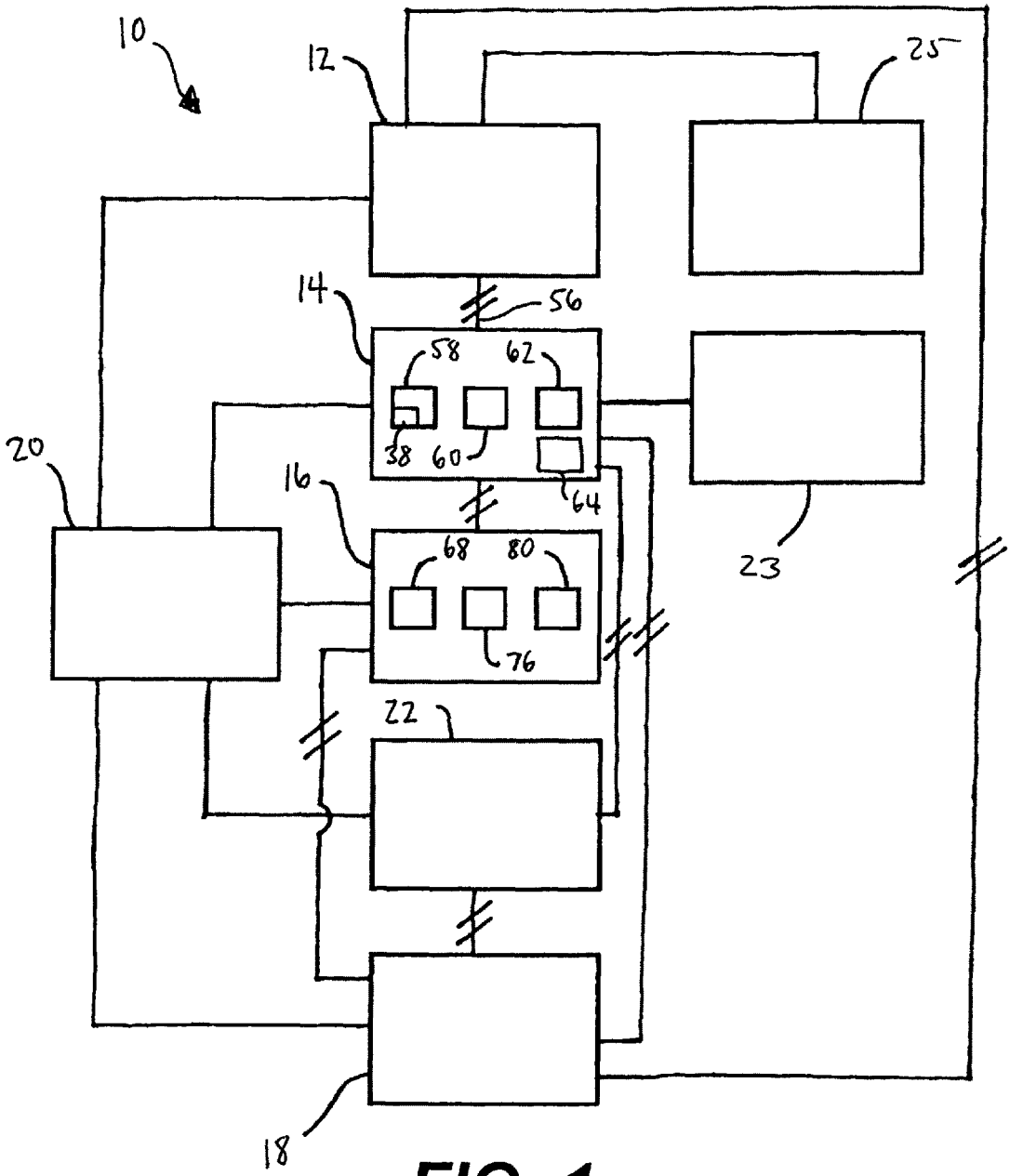
FIG. 1 is a schematic view of a performance enhancer, according to an aspect of the present disclosure.

According to one aspect of the present disclosure, a performance enhancer 10 is shown in FIG. 1. The performance enhancer 10 may be used to enhance a player's performance in racket sports, such as, for example, tennis, table tennis, platform tennis, racketball, squash, badminton, and/or any other racket sports. The performance enhancer 10 may include a data collection system 12, a processor 14, a feedback system 16, a racket adjustment system 22, and an energy supply 18, operatively coupled to and/or forming a part of a racket 20. The performance enhancer 10 may also include or operatively couple to an external electrical device 23 and/or an accessory 25 used with the racket 20.

Figure 2:
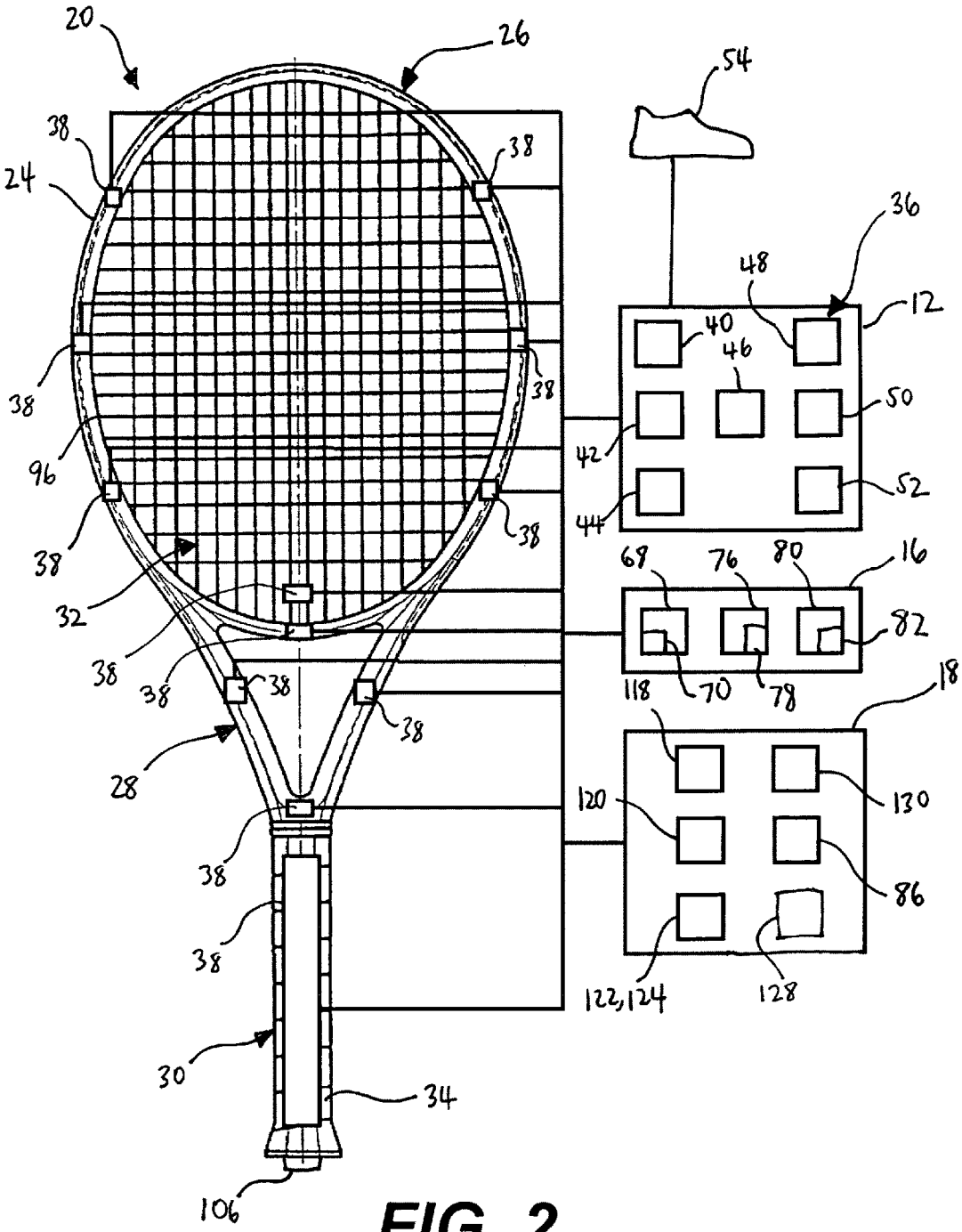
FIG. 2 is a front view of a racket, according to an aspect of the disclosure.

As shown in FIG. 2, the racket 20 may include a frame 24. The frame 24 may include a head 26, a throat 28, and a handle 30. The head 26 may include strings 32 for striking a ball. A grip 34 may be coupled to the handle 30, and may contact a user's hand.

The data collection system 12 may include at least one sensor assembly 36. The at least one sensor assembly 36 may be coupled to the racket 20, to sense one or more parameters associated with the racket 20 during use of the racket 20, and to generate one or more signals indicative of the one or more sensed parameters. Potential locations 38 for the at least one sensor assembly 36 on the racket 20 are shown in FIG. 2. One of the locations 38, corresponding to a space between a bumper material 112 and the frame 24, is shown in greater detail in FIGS. 13 and 14. Another of the locations 38, corresponding to a space on the handle 30, is shown in greater detail in FIG. 15.

The at least one sensor assembly 36 may include at least one accelerometer 40. The at least one accelerometer 40 may be located at any of the potential locations 38. The at least one accelerometer 40 may be used to measure acceleration associated with racket movement. The measured acceleration, along with the mass of the racket 20 and the mass of a ball struck with the racket 20, may be used to determine the real speed at which the ball is struck by the racket 20. The real ball speed is an indicator of a player's skill level, and thus, since racket speed is directly related to the real ball speed, racket speed is also an indicator of a player's skill level.

The impact force generated when the racket 20 makes contact with a ball can be calculated based on ball speed, racket speed, and contact time between the ball and the racket 20. The impact force may be used to predict whether a player may develop an injury. Additionally or alternatively, the impact force may be used to predict the life span of the racket 20.

It is also contemplated that the at least one accelerometer 40 may include multiple accelerometers, located at a plurality of the potential locations 38 in FIG. 2. For example, the at least one accelerometer 40 may include three accelerometers located around the strings 32 on or in the head 26 of the racket 20 at, for example, locations 38 corresponding to a three o'clock position (at the right side of the head 26), a six o'clock position (at the bottom of the head 26 or the top of the throat 28), and a nine o'clock position (at the left side of the head 26) of the racket 20. The readings from the three accelerometers have different profiles depending on the impact location of the ball on the strings 32. By comparing the collected data from the three accelerometers to known profiles associated with specific impact locations, the impact location of the ball on the surface formed by the strings 32 may be determined.

Additionally or alternatively, the at least one sensor assembly 36 may include at least one anemometer 42. The at least one anemometer 42 may be located at one or more of the locations 38 in FIG. 2. For example, the at least one anemometer 42 may be mounted on the strings 32 of the racket 20 near the throat 28. The at least one anemometer 42 may measure airspeed relative to the racket 20 during movement of the racket 20. The relative airspeed may be used to measure parameters similar to those measured by the at least one accelerometer 40.

Figure 13:
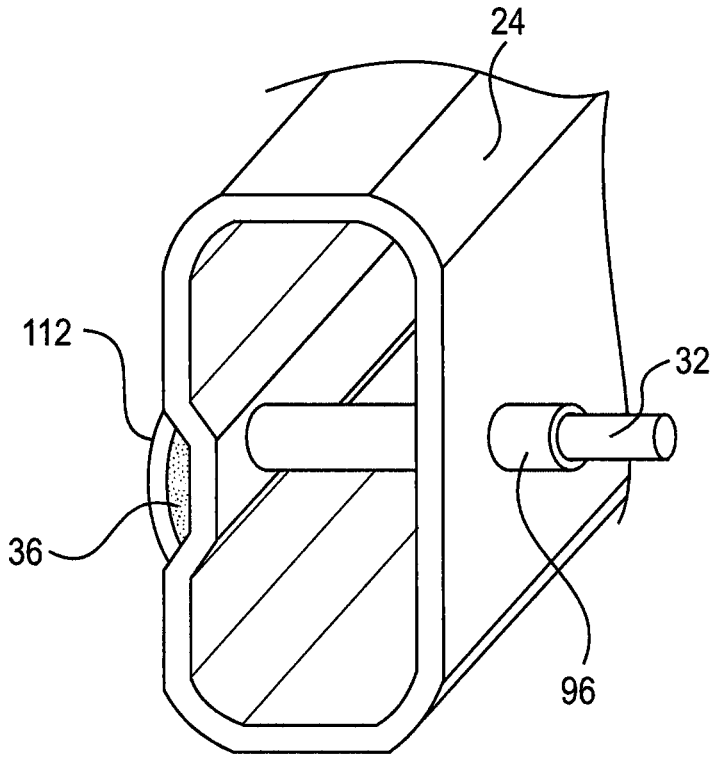
FIG. 13 is a perspective view of a cross-section of a racket frame, according to an aspect of the disclosure.
Figure 14:
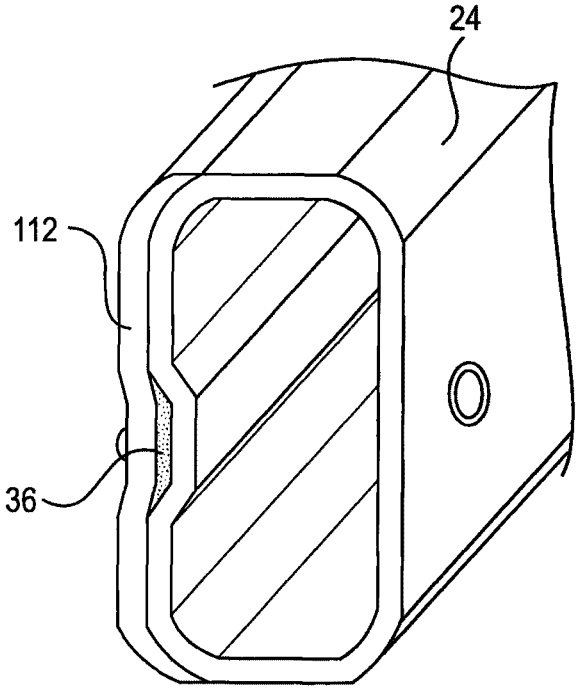
FIG. 14 is a perspective view of a cross-section of another embodiment of the racket frame, according to an aspect of the disclosure.

Additionally or alternatively, the at least one sensor assembly 36 may include at least one pressure sensor 44. The at least one pressure sensor 44 may be located at one or more of the locations 38. For example, the at least one pressure sensor 44 may be positioned in contact with one or more grommets 96 of the racket 20, as shown in FIGS. 2, 13, and 14, to provide an indication of tension in a single string of the strings 32 or an array of the strings 32. By monitoring the tension, the at least one pressure sensor 44 may determine whether any reductions in tension have occurred over time, thus providing an indication of string fatigue in the strings 32. The at least one pressure sensor 44 may also sense increases in tension during impact between the strings 32 and a ball, thus providing an indication of the timing of the impact and its severity. It is contemplated that the at least one pressure sensor 44 may include multiple pressure sensors, such as, for example, one pressure sensor sensing the tension of one or more of the main strings of the strings 32, and another pressure sensor sensing the tension of one or more of the cross strings of the strings 32. Understanding and controlling tension in the strings 32 may affect a player's performance because string tension affects ball speed and vibration levels in the racket 20.

Figure 15:
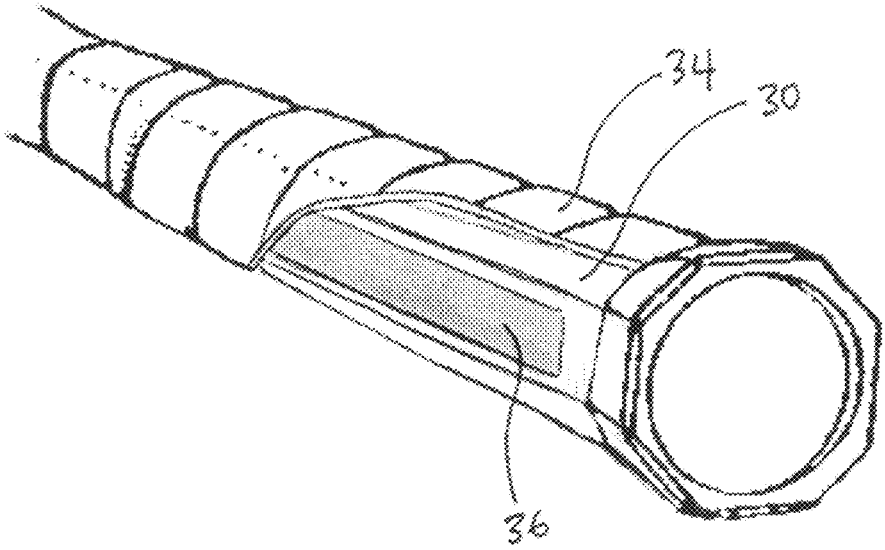
FIG. 15 is a perspective view of a racket handle, according to an aspect of the disclosure.

Additionally or alternatively, the at least one pressure sensor 44 may be coupled to the handle 30 or the grip 34 of the racket 20, as shown in FIG. 15. As such, the at least one pressure sensor 44 may provide signals indicative of the pressure distribution of the player's hand on the handle 30 and grip 34, and also of moments where the pressure distribution changes. The pressure distribution may change one or more times from the beginning of a stroke to the end. Thus, the signals from the at least one pressure sensor 44 may change over the period of time in which the stroke is performed. Since a tight grip on the grip 34 and the handle 30 may be desirable on impact, and a looser grip may be desirable at other times to improve racket speed, the at least one pressure sensor 44 may be useful for providing a user with information on whether the change from a loose grip to a tighter grip, and vice-versa, was performed at the proper time. Further, impact between the strings 32 and a ball may be identified where the signals from the at least one pressure sensor 44 undergo a change having a magnitude that falls outside a predetermined range, and/or that occurs over a time period corresponding to an impact. It is also contemplated that the at least one pressure sensor 44 may include a matrix of pressure sensors coupled to the handle 30 or the grip 34 to improve the accuracy of the pressure distribution signals.

The at least one sensor assembly 36 may also include a strain gauge or sensor 46. The at least one strain sensor 46 may provide a signal indicative of changes in strain in the racket 20, including, for example, in the frame 24 of the racket 20. The impact of a ball against the strings 32 may deform the frame 24 by causing it to bend or twist. The bending or twisting may affect strain levels in the frame 24. For bending, there may be areas of the frame 24 that become longer (e.g., on a convex side of a bent portion of the frame 24), and areas that become shorter (e.g., on a concave side of a bent portion of the frame 24). The at least one strain sensor 46 may be located at one or more of the locations 38, shown in FIG. 2, to detect changes in strain levels, or may be located on whatever area of the frame 24 undergoing a measurable change in strain levels. Examples of strain sensitive sensors that may be used include a strain gauge, a strain sensitive filament coupled to the strings 32, and piezoelectric-type strain sensors that generate signals based on vibrations in the striking element.

Signals from the at least one strain sensor 46 may directly relate to impact forces generated when a ball impacts against the strings 32. Such signals can be evaluated to determine if the impact forces exceed a threshold amount at which injuries are known to occur and/or racket durability is negatively affected.

Additionally or alternatively, the at least one sensor assembly 36 may also include at least one piezoelectric sensor 48. The at least one piezoelectric sensor 48 may be located at one or more of the locations 38 shown in FIG. 2. The at least one piezoelectric sensor 48 may take a mechanical input, such as pressure, acceleration, strain, or force, and convert it to an electrical output. Thus, the at least one piezoelectric sensor 48 may be used as the accelerometer, pressure sensor, force sensor, and/or strain sensor described above.

It is also contemplated that the at least one piezoelectric sensor 48 may include multiple piezoelectric sensors, located at a plurality of the potential locations 38 in FIG. 2. For example, the at least one piezoelectric sensor 48 may include three piezoelectric sensors. Readings from the three piezoelectric sensors may fit a profile depending on the impact location of the ball on the strings 32. By comparing the collected data to known profiles, the impact location of the ball on the surface formed by the strings 32 may be determined.

Additionally or alternatively, the at least one sensor assembly 36 may also include at least one skin sensor 50. The at least one skin sensor 50 may be coupled to the grip 34 of racket 20, in contact with the palm of a player's hand. The skin sensor 50 may be used to determine the player's heart rate. It is also contemplated that the at least one skin sensor 50 may include an electrode that may be placed on the player's skin to determine his or her heart rate. Information about the energy used to swing the racket 20, derived from at least one of the other sensors described above, may be combined with the measured heart rate information to provide an indication of the calories burnt for each stroke, a period of play, and/or an entire match.

Additionally or alternatively, the at least one sensor assembly 36 may also include at least one accessory sensor 52 coupled to an accessory 25. The accessory sensor 52 may, for example, be in a player's shoes 54 and/or a glove (not shown). When in the player's shoes 54, the at least one accessory sensor 52 may include GPS technology to track the player's foot movement, since footwork may be vital to executing a proper stroke technique. The at least one accessory sensor 52 may also include at least one pressure sensor 44 to monitor pressure distribution in the player's shoes 54. Such sensors may be placed in the player's insoles.

It should be understood that the at least one sensor assembly 36 may include one of the above-described sensors, multiples of the above-described sensors, and/or combinations of the above-described sensors.

The at least one sensor assembly 36 may send signals to the processor 14 via a communication assembly 56. The communication assembly 56 may include any suitable form of electronic communication, including, for example, a transmitter/receiver integrated into the at least one sensor assembly and/or the processor 14, BLUETOOTH, Wi-Fi, IEEE 802.11, a parallel port, an Ethernet adapter, a FireWire (IEEE 1394) interface, a Universal Serial Bus (USB) and plug, and/or cables, wires, and other suitable connectors. It is contemplated that at least a portion of the communication assembly 56 may be incorporated into the material forming the frame 24. For example, at least a portion of the communication assembly may be incorporated during the hardening of a thermoset of a carbon reinforced composite material used to form the frame 24 of the racket 20.

The processor 14 may be mounted on or inside the frame 24 of the racket 20. For example, the processor 14 may be mounted inside the handle 30 of the racket 20.

The processor 14 may process the signals using an electronic analyzer 60. For example, the processor 14 may analyze the signals sent by the at least one sensor assembly 36 and determine one or more values including, for example, racket speed, ball speed, racket acceleration, pressure, pressure distribution, strain, impact force, stroke length, impact location, heart rate, calories burnt, foot position, string tension, contact time, racket life span, and/or any other values that can be calculated based on known data and collected data from the at least one sensor assembly 36, using one or more algorithms applied with the electronic analyzer 60.

The processor 14 may also compare the sensor signals with other data, such as historical data related to the performance of another player, to provide a user with feedback regarding how his or her performance compares to that of the other player or a predetermined ideal. It is contemplated that the processor 14 may include a processor on or in the racket 20, and/or a processor in an electronic computing device, such as a mobile electronic computing device, personal digital assistant, and/or computer, separate from the racket 20 but in communication with the at least one sensor assembly 36 through any suitable form of electronic communication.

The processor 14 may also include a microcontroller 58 operatively coupled to the electronic analyzer 60. The microcontroller 58 may include a calibrating unit 62 configured to automatically initialize the electronic analyzer 60. During automatic initialization, the calibrating unit 62 may automatically correct and/or calibrate data and values based on one or more factors, including, for example, the type of racket used, the type of strings used, the tension of the strings, and/or the type of game ball struck. Thus, the analyzer 60 and the microcontroller 58 may be configured to operate interactively.

The microcontroller 58 may also include a storage unit or memory location 38. The memory location 38 may include any type of computer memory known in the art (e.g., RAM or ROM), flash memory, one or more memory chips, and/or any suitable computer readable medium. It is also contemplated that the memory location 38 may be configured to be connected to an external memory location (e.g., computer memory, flash memory, memory chips, and/or any suitable computer readable medium) so data from one memory location can be downloaded or transferred to the other memory location. The memory location 38 may store signals, values, physical parameters, and/or any other types of data.

The performance enhancer 10 may also include the feedback system 16. The feedback system 16 may provide a user with feedback, such as visual, audio, and/or tactile feedback before, during, and/or after play. The feedback may be related to the signals, values, and/or other data from the at least one sensor assembly 36 and/or the processor 14.

Figure 11:
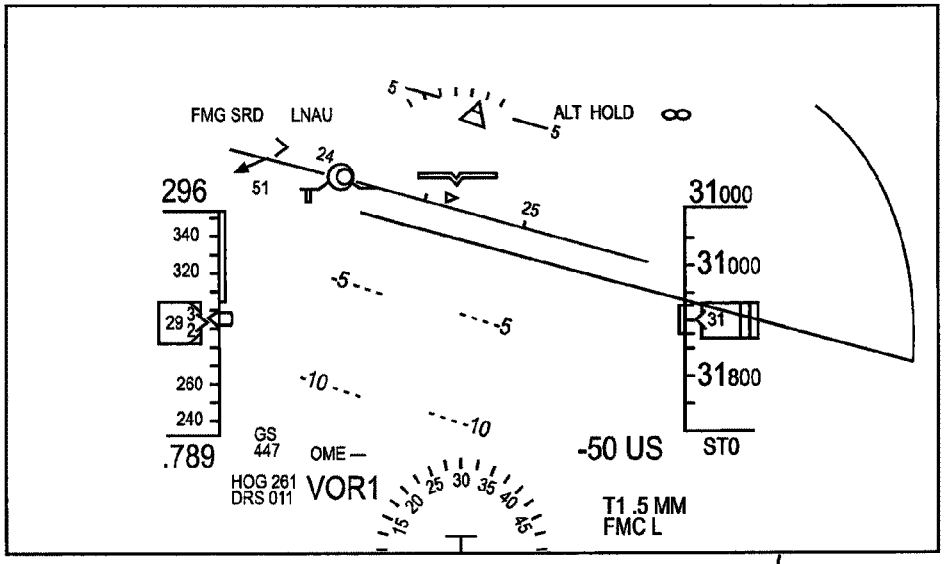
FIG. 11 shows a heads-up video display, according to an aspect of the disclosure.
Figure 12:
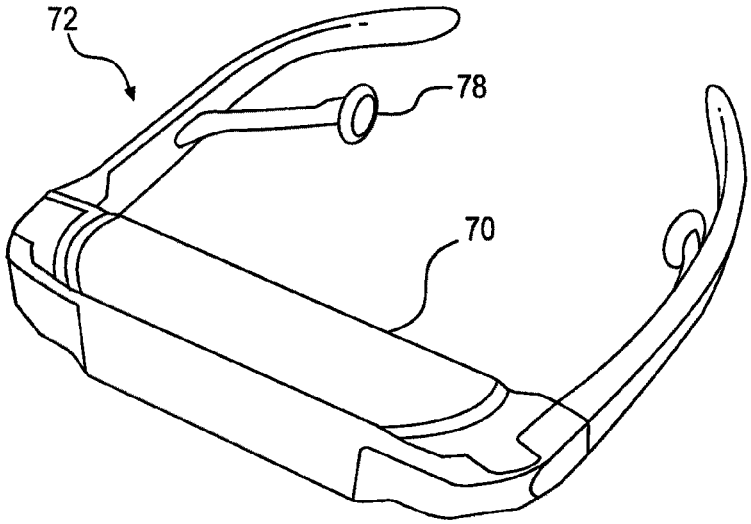
FIG. 12 is a perspective view of a headset, according to an aspect of the disclosure.

Visual feedback may be provided by a visual feedback assembly 68. The visual feedback assembly 68 may include a display 70. The display 70 may be a screen on the racket 20 at, for example, one or more of the locations 38 of FIG. 2. It is also contemplated that the display 70 may be a screen in a virtual reality headset 72, such as that shown in FIG. 12, or a screen in a heads up display 74 similar to those used in aircraft, as shown in FIG. 11, to provide a user with feedback during play. It is further contemplated that visual feedback may be provided by a screen on any suitable external electronic computing device 23, including, for example, an IPOD, ITOUCH, and/or IPHONE from Apple Inc. of Cupertino, Calif., and/or a similar mobile device.

Audio feedback may be provided by an audio feedback assembly 76, including, for example, headphones and/or speakers 78 operably coupled to the racket 20, by being coupled to the frame 24 at one or more of the locations 38 in FIG. 2, or by being coupled to the processor 16 by the communication assembly 56. It is also contemplated that the frame 24 of the racket 20 may be configured to act as resonating body to provide audio feedback by incorporating piezoelectric fibers into the frame structure and using enough amplification so that the walls of the frame 24 can act as a speaker. It is further contemplated that audio feedback may be provided by a speaker on any suitable external electronic computing device 23, including, for example, an IPOD, ITOUCH, and/or IPHONE from Apple Inc. of Cupertino, Calif., and/or a similar mobile device.

Tactile feedback may be provided by a tactile feedback assembly 80. During play, players may find it helpful to receive tactile feedback regarding the ball impact location in the form of shocks and vibrations. These shocks and vibrations, however, may be harmful to the player. Thus, rackets often times include shock and vibration dampeners, which are advantageous in that they can help reduce the likelihood of injuries due to shocks and vibrations, but are disadvantageous in that they reduce or eliminate the tactile feedback provided by the shocks and vibrations. The tactile feedback assembly 80 may provide a remedy by introducing non-harmful stimuli, such as low energy vibrations or mild electrical shocks, to replace the tactile feedback reduced or eliminated by dampeners. For example, at the location 38 associated with the grip 34 or handle 30 of the racket 20, a vibrating device 82 may be provided to generate vibrations with a frequency and/or amplitude that a player can feel with his or her hand. It is also contemplated that the grip 34 or handle 30 of the racket 20 may include vibrating zones under the player's finger tips only, as the player's sense of touch may be most sensitive in those areas. The frequency as well as the amplitude of the tactile feedback may be correlated to any of the previously described signals, values, and/or data from the processor 14, including, for example, those indicative of the impact force and/or impact location. To avoid any influence of the playing characteristic of the racket 20, vibrating devices may be uncoupled from the frame structure of the racket 20.

It should be understood that feedback may be provided during play, and also after play. After play, collected data, calculated values, and other information may be transferred to an external electronic device, including, for example, mobile computing devices, an IPOD, an ITOUCH, an IPHONE, a watch, a PDA, a personal computer, and other suitable external electronic computing devices 23. Such external electronic devices 23 may not offer immediate feedback, but may be more powerful in their analysis and storage capabilities than other devices located on or in the racket 20. With this more powerful analysis, aspects of a player's technique during longer time periods, including an entire match or series of matches, can be monitored and analyzed. Moreover, such external electronic devices may include large amounts of data of other players, including data of professional players and their special techniques, so that players can benchmark their technique of playing with the best players in the world. It is also contemplated that data may be collected from multiple players, and that such data may be uploaded to a central memory location, including, for example, an Internet-connected server or other suitable computer networking apparatus, for analysis and comparison purposes.

Figure 3:
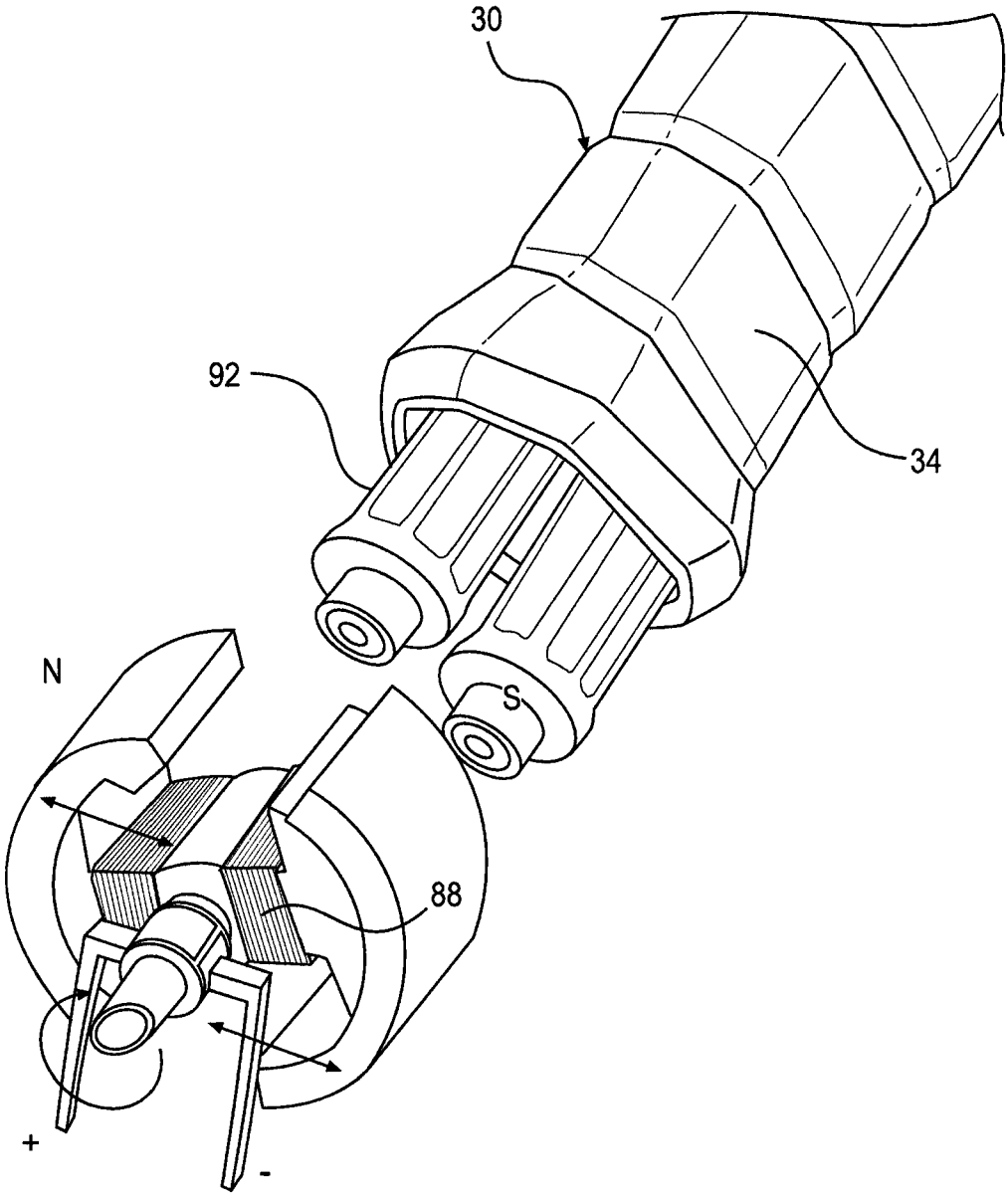
FIG. 3 is a perspective view of a racket handle, according to an aspect of the disclosure.

Electric voltage for powering operation of the at least one sensor assembly 36, processor 14, visual feedback assembly 80, audio feedback assembly 76, and tactile feedback assembly 80 of the performance enhancer 10 may be provided by the energy supply 18. The energy supply 18 may be coupled to or at least partially contained within the racket 20. For example, as shown in FIG. 3, the power source may include a battery 130 located inside the grip 34 or handle 30 of the racket 20. Additionally or alternatively, electric voltage may be provided through the use of one or more piezoelectric elements 86, shown in FIG. 9, on or in the racket 20. The one or more piezoelectric elements 86 may generate electric power by transforming mechanical shock and vibrations produced during use of the racket 20 into electric voltage. It is also contemplated that the one or more piezoelectric elements 86 may transfer electric energy generated by the vibrations into the battery 130 to load or charge the battery 130, allowing the accumulated energy to be released when needed. Examples of suitable piezoelectric elements are described in U.S. Pat. Nos. 6,974,397 and 7,160,286, the disclosures of which are herein incorporated by reference. It should be understood that the one or more piezoelectric elements 86 may be located at one or more of the locations 38 shown in FIG. 2.

Figure 4:
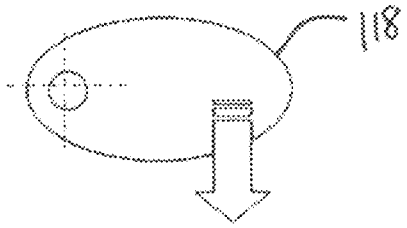
FIG. 4 is a front view of an off-center gravitational mass, according to an aspect of the disclosure.
Figure 5:
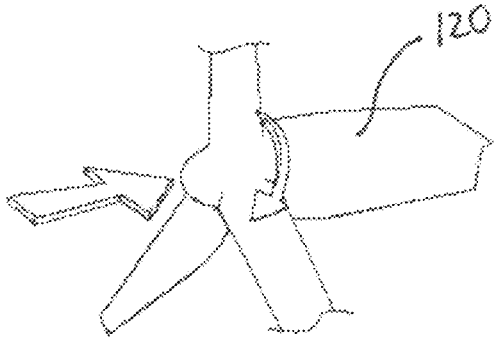
FIG. 5 is a perspective view of a fan generator, according to an aspect of the disclosure.
Figure 6:
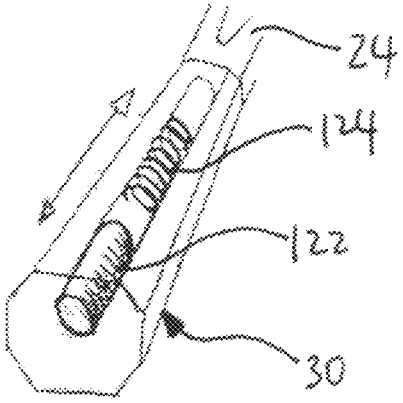
FIG. 6 is a perspective view of a magnet and coil assembly, according to an aspect of the disclosure.

It is also contemplated that energy may be harvested using solar cells 128 at one or more of the locations 38, and/or by converting swinging of the racket 20 into electrical energy using a magnet and coil assembly 122, 124 similar to those found in flashlights (shown in FIG. 6), an off-center gravitational mass 118 similar to those found in automatic watches (shown in FIG. 4), and/or a fan generator 120 similar to an windmill turbine (shown in FIG. 120). The magnet and coil assembly 122, 124, off-center gravitational mass 118, and fan generator 120, may be positioned at one or more of the locations 38 in FIG. 2, including, for example, in the handle 30 of the racket 20.

The racket adjustment system 22 of the performance enhancer 10 may adjust one or more physical properties of the racket 20 to enhance the performance of the racket 20. In one embodiment, electrical energy from the energy supply 18 may be used to power an electric motor 88 of the adjustment system 22, shown in FIGS. 7 and 8. Actuation of the electric motor 88 changes the physical properties of the racket 20 by making the racket 20 stiffer, changing the tension in the strings 32 of the racket 20, and/or changing a balance point of the racket 20.

Figure 7:
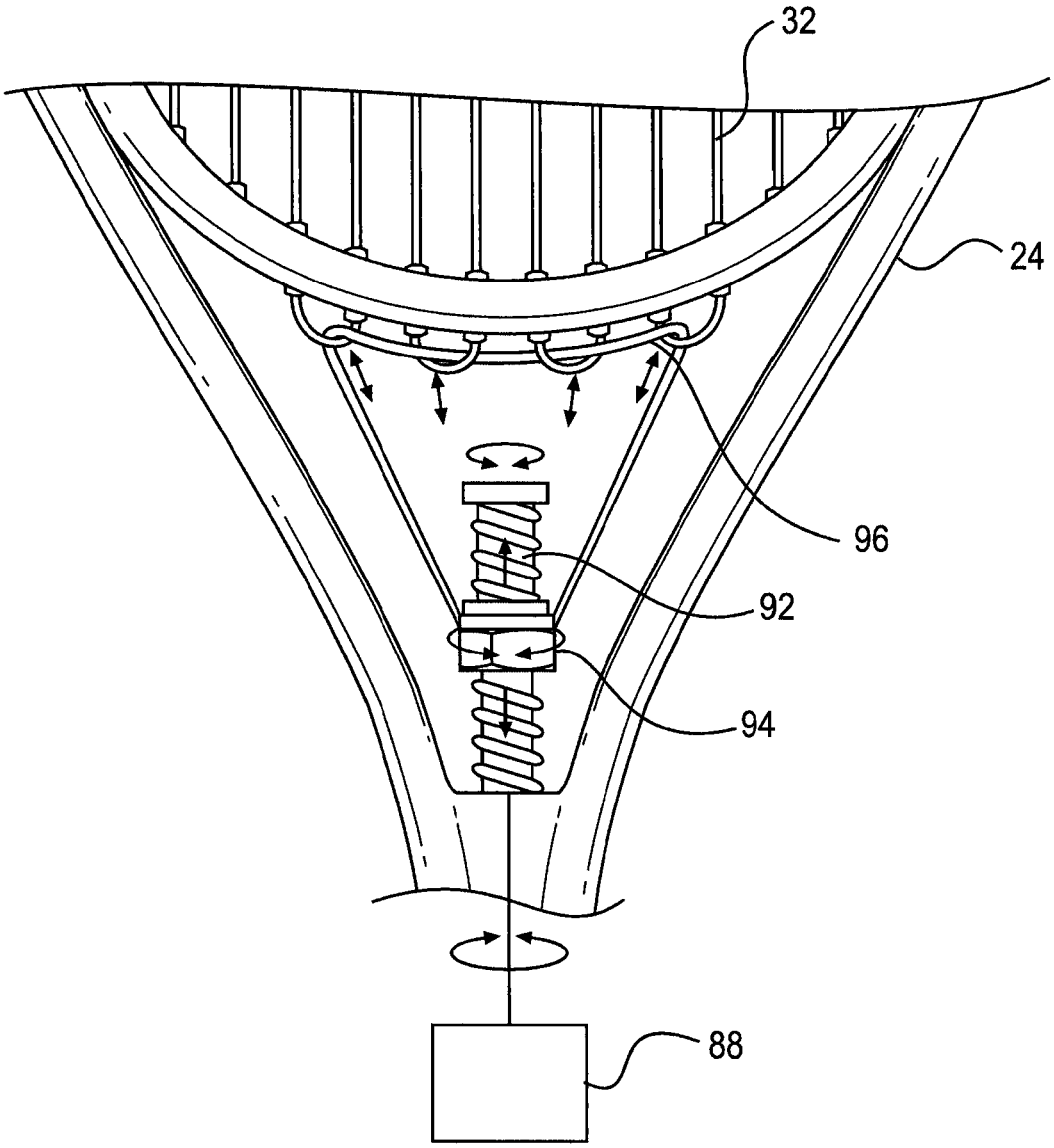
FIG. 7 is a front view of a racket adjustment assembly, according to an aspect of the disclosure.

In the embodiment shown in FIG. 7, changes to the physical properties of the racket 20 can be achieved using a heterogeneous rod 92 in the frame 24, which may be rotated by the motor 88. The motor 88 may rotate an externally threaded rod 92 about its longitudinal axis. A nut 94 or similar element having internal threads configured to engage the external threads on the threaded rod 92 may be coupled to the rod 92. The nut 94 may also be coupled to the ends of a grommet element 96. The ends of the grommet element 96 may prevent the nut 94 from rotating as the rod 92 rotates. The strings 32 of the racket 20 may be looped about the grommet element 96 such that the grommet element 96 extends between the strings 32 and the frame 24. By increasing tension in the grommet element 96, the tension in the strings 32 may be increased. By decreasing the tension in the grommet element 96, the tension in the strings 32 may be decreased. Tension in the grommet element 96 may be adjusted by adjusting the position of the nut 94 on the rod 92. For example, when the motor 88 turns the rod 92 in a first direction, the nut 94 may not rotate due to its connection to the grommet element 96. Relative rotation between the rod 92 and the nut 94 may cause the nut 94 to travel along the rod 92 away from the handle 30. Movement of the nut 94 away from the handle 30 (and toward the strings 32) decreases tension in the grommet element 96, thereby decreasing tension in the strings 32 looped about the grommet element 96. When the motor 88 turns the rod 92 in a second direction opposite the first direction, relative rotation between the rod 92 and the nut 94 may cause the nut 94 to travel toward the handle 30. Movement of the nut 94 toward the handle 30 (and away from the strings 32) increases tension in the grommet element 96, thereby increasing the tension in the strings 32 looped about the grommet element 96. These adjustments may take place before, during, or after a stroke, or at any other suitable time.

Figure 8:
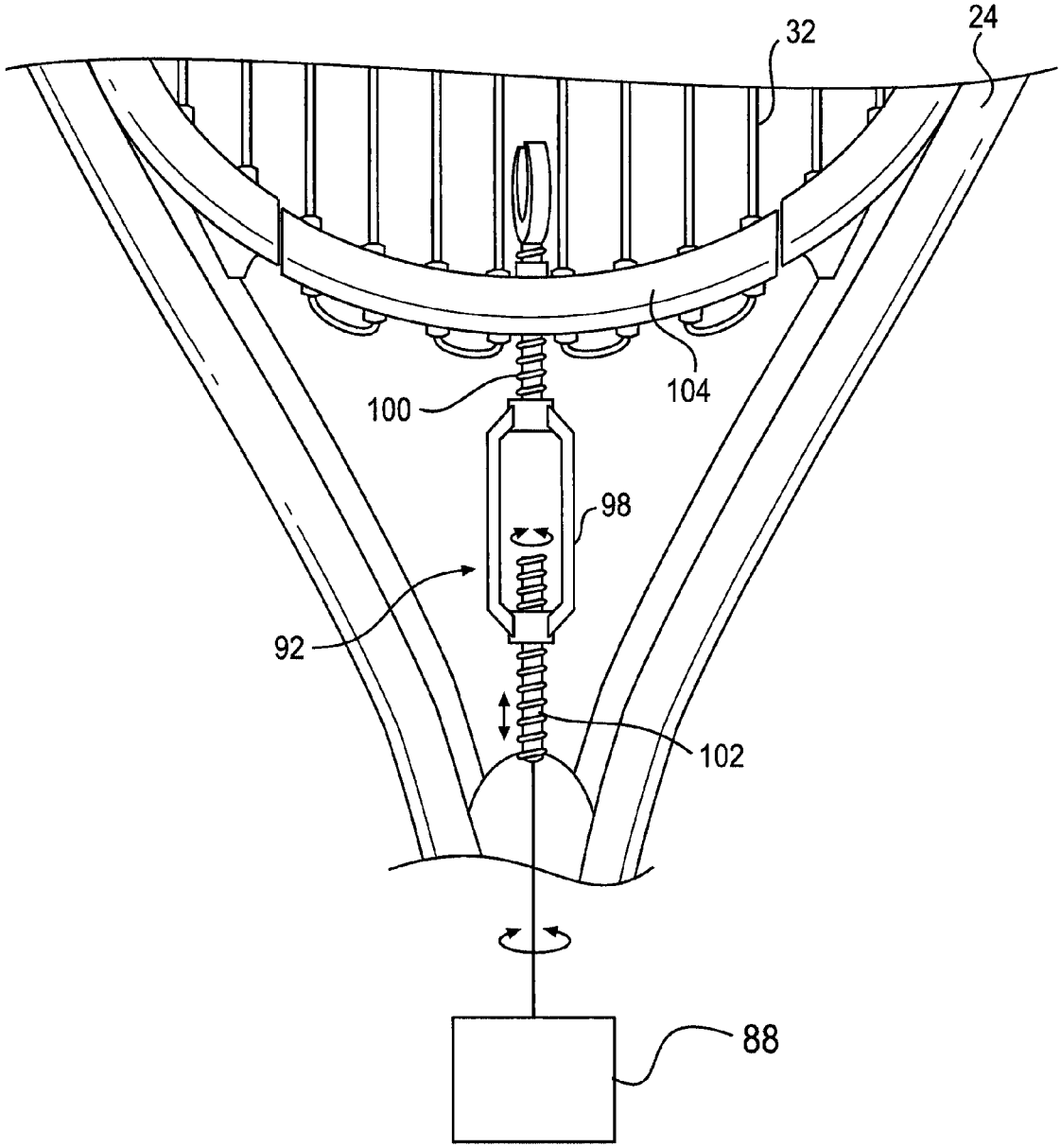
FIG. 8 is a front view of another racket adjustment assembly, according to an aspect of the disclosure.

In the embodiment shown in FIG. 8, the rod 92 includes a receiver 98, a first threaded portion 100 received in a first internally threaded end of the receiver 98, and a second threaded portion 102 received in a second internally threaded end of the receiver 98. The second threaded portion 102 may be coupled to a movable throat piece 104 of the racket frame 24. As the motor 88 turns the first threaded portion 100 in a first direction, the second threaded portion 102 may be pushed away from the racket handle 30 along the longitudinal axis of the first threaded portion 100. Thus, the movable throat piece 104 coupled to the second threaded portion 102 may also be pushed away from the racket handle 30, thus decreasing the tension in the strings 32 looped about the movable throat piece 104. As the motor 88 turns the first threaded portion 100 in a second direction opposite the first direction, the receiver 98 may be drawn toward the racket handle 30, thus increasing the tension in the strings 32 looped about the movable throat piece 104. These adjustments may take place before, during, or after a stroke, or at any other suitable time The motor 88 may be controlled by a user. For example, the user may actuate a button or switch 106 (FIG. 2) to selectively supply electrical power to the motor 88. The switch may include a multi-directional switch, allowing the user to drive the motor 88 in a first direction by moving the switch in a first direction, and to drive the motor 88 in a second direction by moving the switch in a second direction. It is also contemplated that a plurality of motors may be provided, and different motors may be actuated, either alone or in combination, to make the desired adjustments. The desired adjustments may be determined based on the signals, values, and other data from the data collection system 12, the processor 14, and/or the feedback system 16, to change racket properties to help bring a parameter associated with a user's performance within a predetermined range of values associated with better play.

Furthermore, it is also contemplated that the motor 88 may be controlled automatically by the processor 14. For example, the processor 14 may collect data from the at least one sensor assembly 36, analyze the collected data, and generate one or more instructions for the adjustment system 22 based on the collected data to tailor properties of the racket 20 to the individual using racket 20 to enhance his or her performance. For example, the instructions generated based on the collected data may control the timing of and/or amount of electric power supplied from the energy supply 18 to the motor 88. The instructions may make changes to racket properties to help bring a parameter associated with a user's performance within a predetermined range of values associated with better play.

Figure 22:
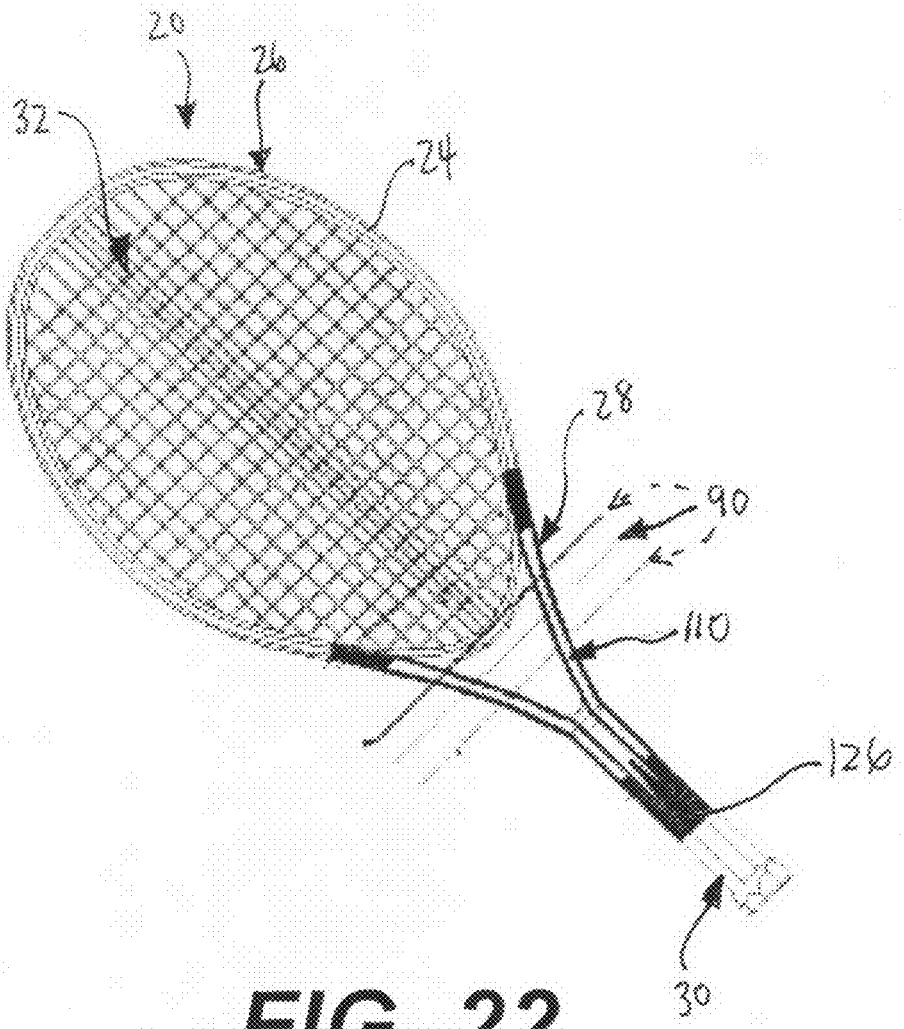
FIG. 22 is a front view of a racket with yet another racket adjustment assembly, according to an aspect of the disclosure.

According to another aspect of the disclosure, a racket's balance may be adjusted before, during, or after a stroke, or at any other suitable time, using electric power and smart material 110. Referring to FIG. 22, which shows a balance point 90 in its high and low positions using dashed lines, a low balance point may be desirable during an initial phase of a stroke, while a high balance point may be desirable during impact. Also, a low balance point may be desirable for volley strokes, where a player may have only a very short time to react to an oncoming ball, and a high balance point may be desirable for serving a ball since it would make the racket 20 more powerful.

Figure 21:
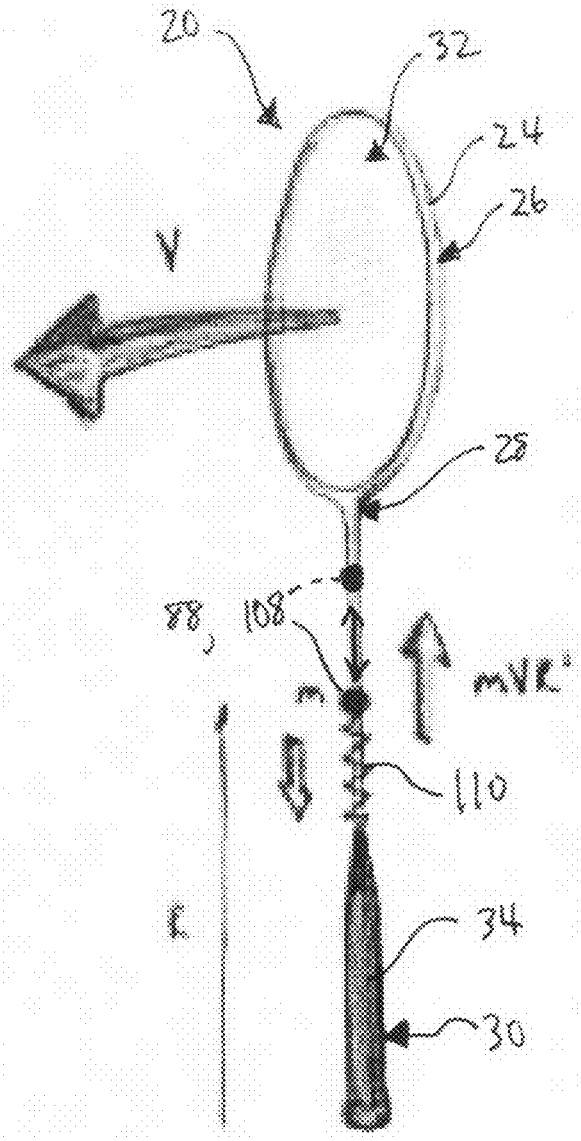
FIG. 21 is a perspective view of a racket with yet another racket adjustment assembly, according to an aspect of the disclosure.

The shifting of the balance point 90 may be accomplished by providing a solid or fluid mass 108 in a frame 24 of the racket 20, as shown in FIG. 21. The solid or fluid mass 108 may be free to move inside the frame 24 when released. Smart material 110 may be used to control the threshold for release of the mass 108, and/or may help accelerate the mass's movements. For example, the mass 108 may be positioned to slide within the frame 24. As the mass 108 moves, the balance point 90 of the racket 20 may also change. As the mass 108 moves toward a head end of the racket 20, the balance point 90 may shift toward the head end. As the mass 108 moves toward a grip end of the racket 20, the balance point 90 may shift toward the grip end. The mass 108 may be suspended in smart material 110, such as in an electrorheological fluid or a magnetorheological fluid. The smart material 110 be stiff or viscous, and may hold the mass 108 in a rest position (e.g., a position close to the grip end), when experiencing a first electrical or magnetic field. This may be desirable, for example, when a player is volleying. The smart material 110 may become more fluid, allowing mass 108 to move toward the head end when experiencing a second electrical or magnetic field. This may be desirable, for example, when a player is serving. The strength of the electrical or magnetic field may be controlled by controlling the strength of a field generator 126, such as a magnet or a solenoid, shown in the grip 34 or handle 30 of the racket 20 in FIG. 22. The strength of the field generator 126 may be controlled using electric power provided by, for example, the energy supply 18. It is also contemplated that mass 108 may be the motor 88 itself. In such an embodiment, the motor 88 may be mounted for travel along the longitudinal axis of a rod 92, and the smart material 110 may be omitted. When electric power is provided to the motor 88, the motor 88 may move along the rod 92, thus changing the balance point of the racket 20.

Figure 9:
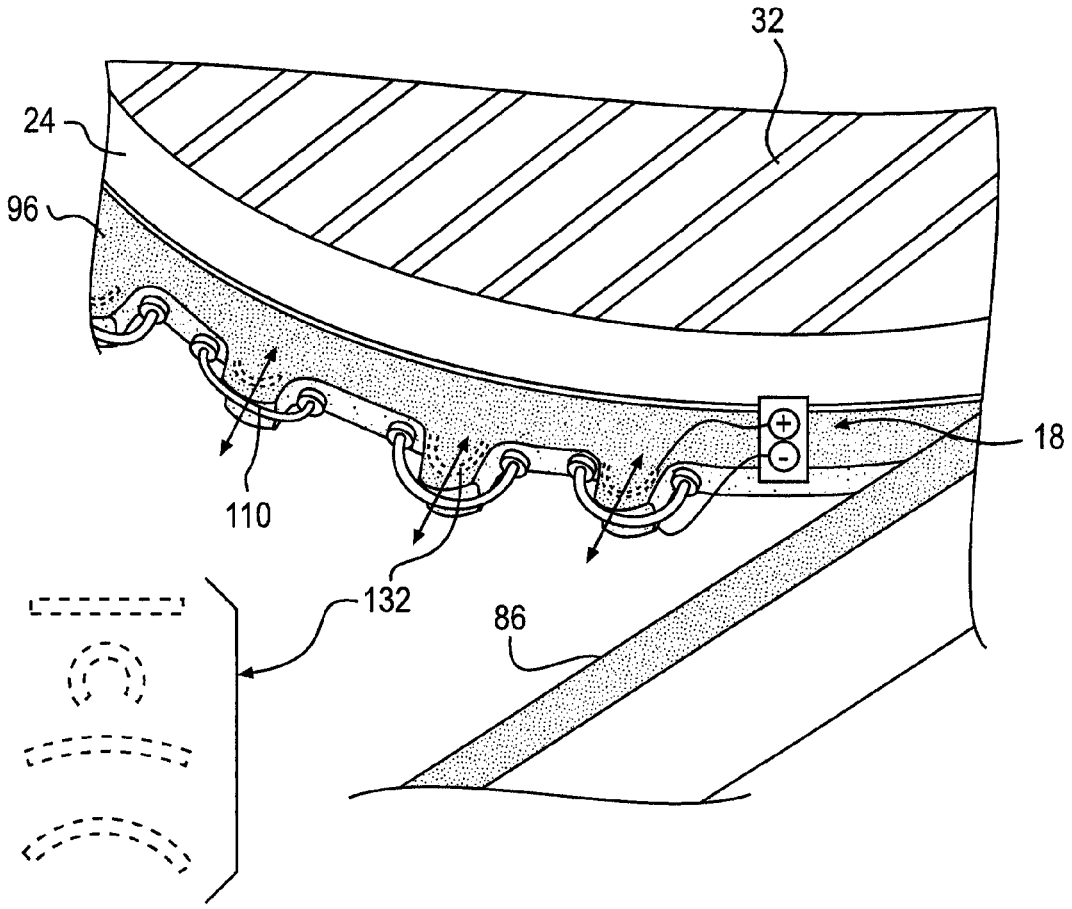
FIG. 9 is a perspective view of yet another racket adjustment assembly, according to an aspect of the disclosure.
Figure 10:
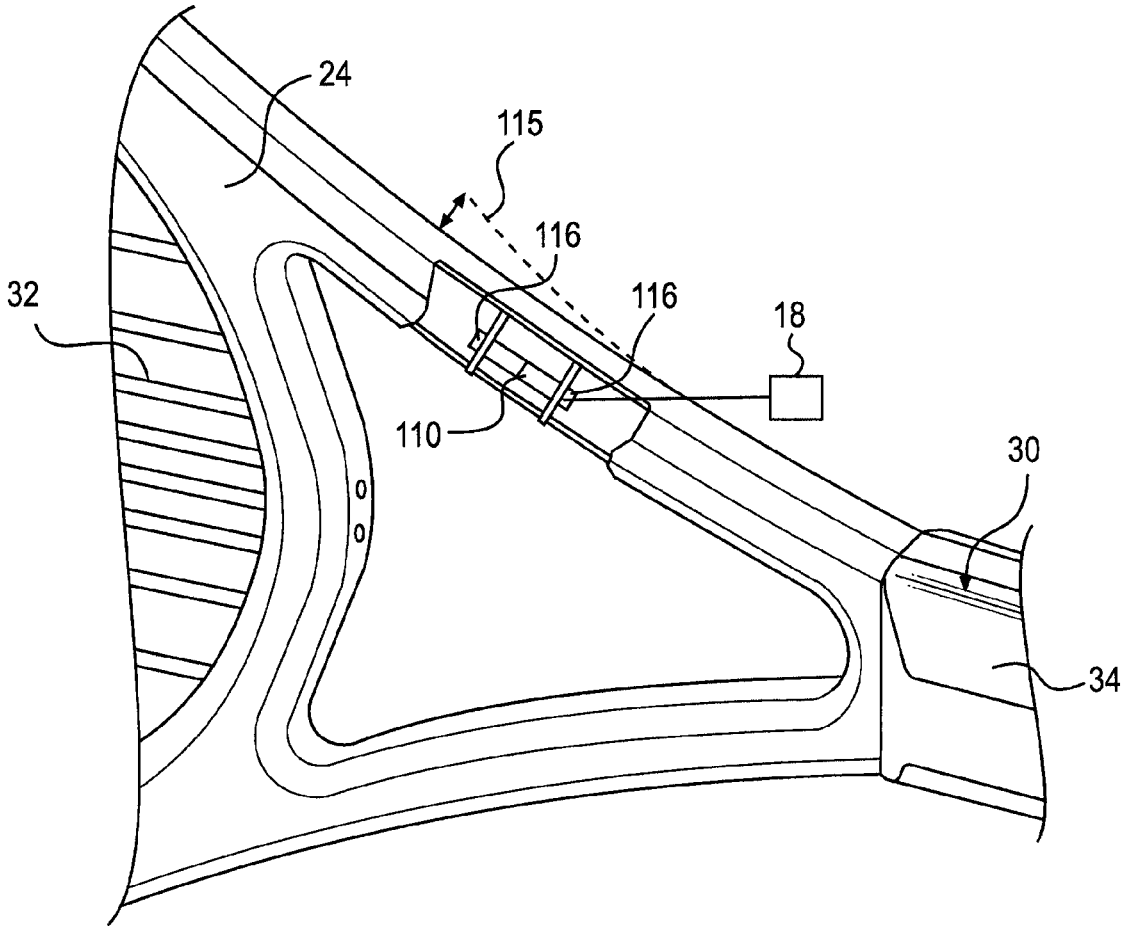
FIG. 10 is a perspective view of yet another racket adjustment assembly, according to an aspect of the disclosure.

According to another aspect of the disclosure, the smart material 110 may be incorporated on or in the frame 24 of the racket 20 and/or one or in the grommet element 96 on the frame 24, as shown in FIG. 9. Electrical energy from the energy supply 18 may be released to the smart material 110 when the strings 32 impact with a ball to stiffen the frame 24 and/or the grommet element 96, thus increasing a player's power and dampening shock and vibrations felt by the player through the frame 24. It is contemplated that the smart material 110 may include a shape memory alloy 132 and/or a piezoelectric element 86 configured to actuate the shape memory alloy 132 to change its shape. The shapes that shape memory alloy 132 can move between is shown in dashed lines in the lower left corner of FIG. 9. As the shape memory alloy 132 changes shape, it may exert forces in the direction of the arrows in FIG. 9, thus changing the stiffness of the frame 24 and/or the grommet element 96.

Figure 16:
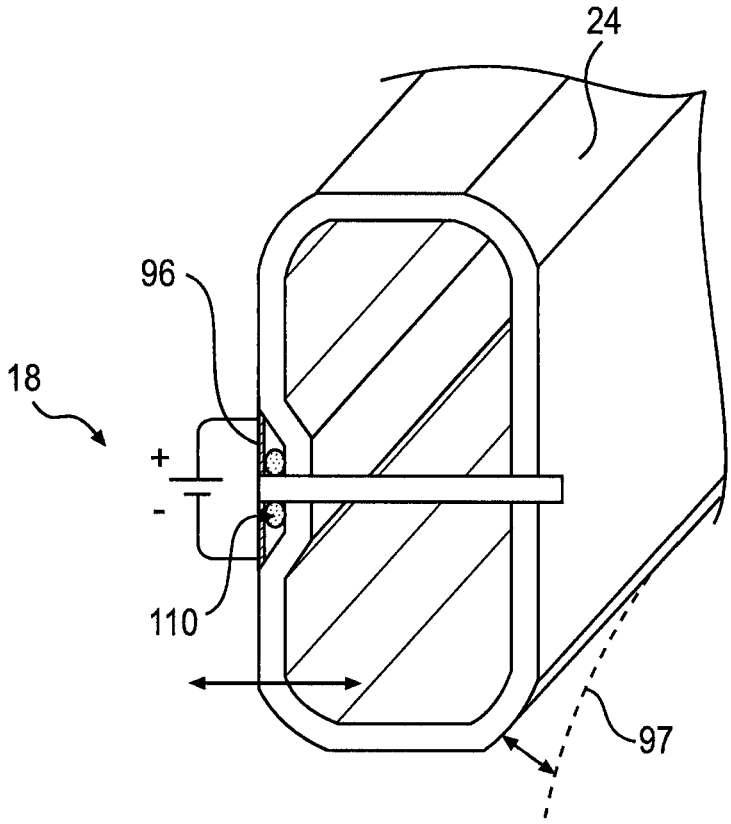
FIG. 16 is a perspective view of a cross-section of yet another embodiment of the racket frame, according to an aspect of the disclosure.
Figure 17:
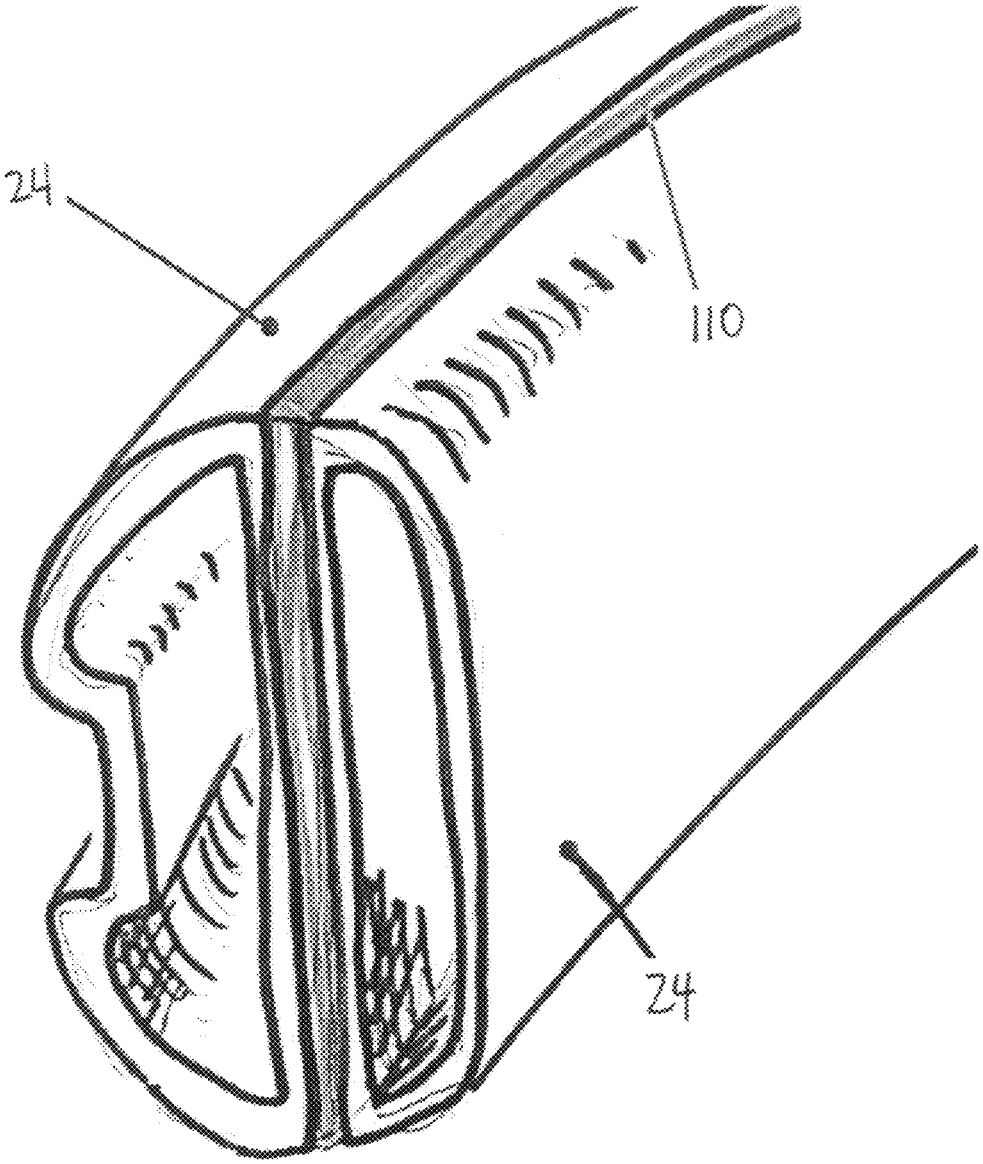
FIG. 17 is a perspective view of a cross-section of yet another embodiment of the racket frame, according to an aspect of the disclosure.
Figure 18:
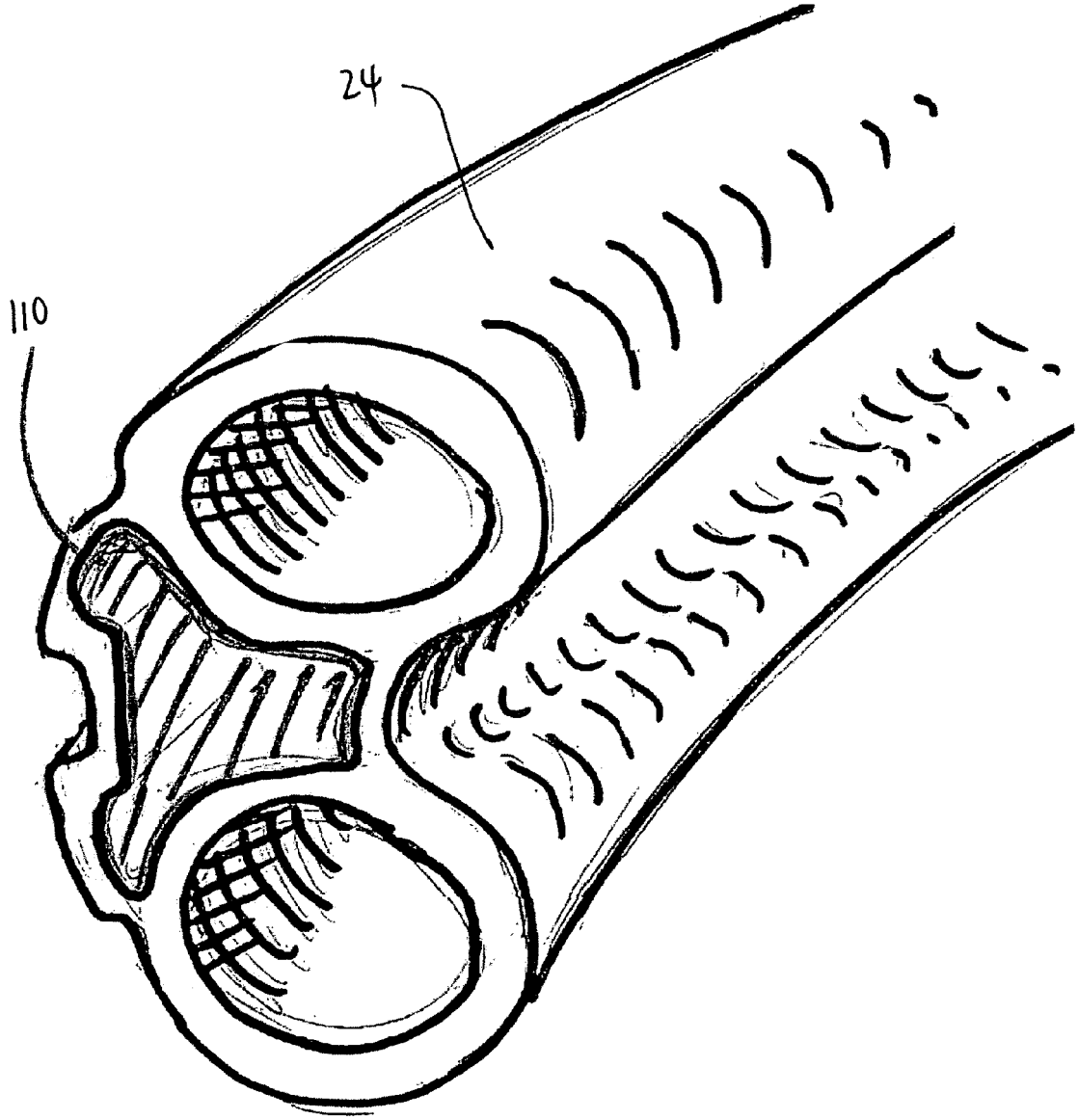
FIG. 18 is a perspective view of a cross-section of yet another embodiment of the racket frame, according to an aspect of the disclosure.
Figure 19:
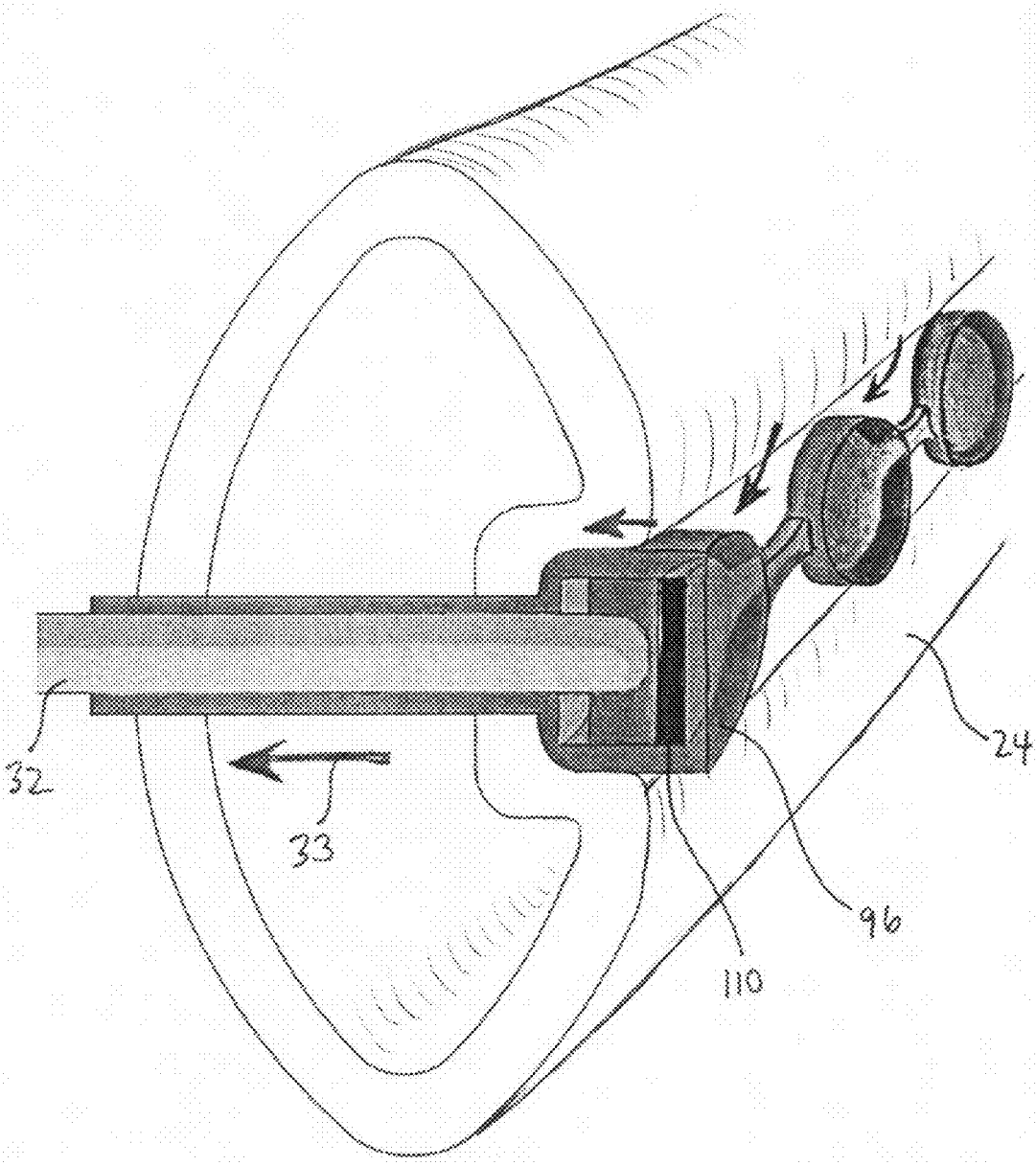
FIG. 19 is a perspective view of a cross-section of yet another embodiment of the racket frame, according to an aspect of the disclosure.
Figure 20:
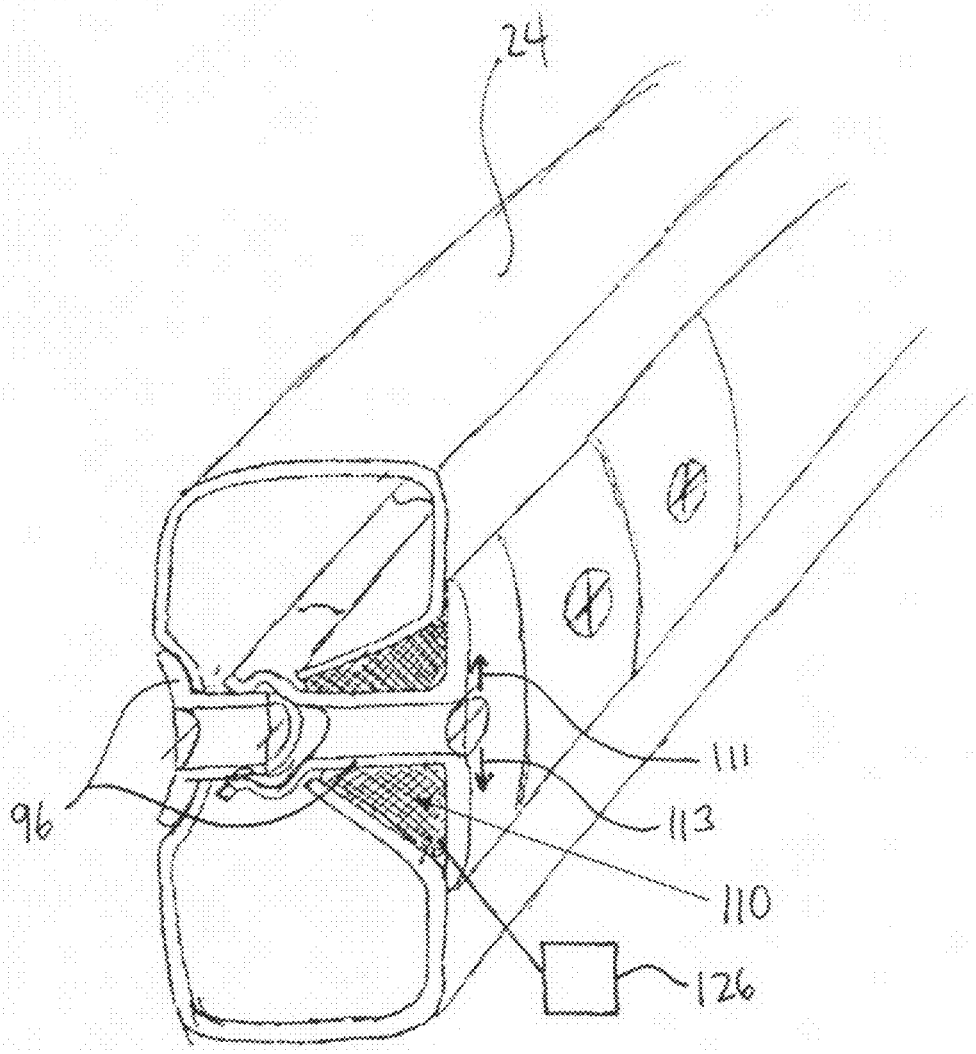
FIG. 20 is a perspective view of a cross-section of yet another embodiment of the racket frame, according to an aspect of the disclosure.

According to another aspect of the disclosure, the smart material 110, in the form of an electrorheological fluid or a magnetorheological fluid, may be provided inside the frame 24 and/or under the grommet element 96, as shown in FIGS. 10, 16-20, and 22. Electric power from the energy supply 18 may be used to actuate a field generator 126 to change an electric field or a magnetic field in and/or surrounding the smart material 110, and therefore change the viscosity and stiffness of the smart material 110. Increasing the viscosity and stiffness of the smart material 110 may increase the stiffness of the frame 24 and/or tension in strings 32. For example, referring to FIG. 19, increasing the viscosity and stiffness of the smart material 110 may hinder or prevent movement of the string 32 in the direction of the arrow 33. Referring to FIG. 20, increasing the viscosity and stiffness of the smart material 110 may hinder or prevent movement of the grommet element 96 in the direction of arrows 111, 113. Referring to FIG. 16, increasing the viscosity and stiffness of the smart material 110 may hinder or prevent bending or twisting of the frame 24 out of the position shown in solid lines.

Decreasing the viscosity and stiffness of the smart material 110, on the other hand, may decrease the stiffness of the frame 24 and/or string tension. With respect to FIG. 19, this decrease may allow greater ease of movement of the string 32 in and away from the arrow 33. Referring to FIG. 20, the decrease may allow the grommet element 96 to move more easily in the direction of arrows 111, 113. Referring to FIG. 16, the decrease may allow the frame 24 to bend and/or twist more easily, and thus, the frame 24 may attain a curvature represented by the dashed line 97 when under stress.

It is contemplated that a user may actuate the button or switch 106 to selectively supply electrical power to change the properties of the smart material 110, and thereby change the properties of the racket 20. For example, the user may control the smart material 110 by controlling when electric power is supplied from the energy supply 18 to the shape memory alloy 132, the piezoelectric device 86, and/or the field generator 126, using the button or switch 106. The user may actuate the button or switch 106 before, during, or after a stroke. The user may actuate the button or switch based on signals, values, and/or other data from the data collection system 12, the processor 14, and/or the feedback system 16, to change racket properties to help bring a parameter associated with a user's performance within a predetermined range of values associated with better play.

It is also contemplated that the smart material 110 may be controlled automatically by the processor 14. For example, the processor 14 may collect data from the at least one sensor assembly 36, analyze the collected data, and generate one or more instructions for the adjustment system 22 based on the collected data to tailor properties of the racket 20 to the individual using racket 20 to enhance his or her performance. For example, the instructions generated based on the collected data may control the timing of and/or amount of electric power supplied from the energy supply 18 to the shape memory alloy 132, the piezoelectric device 86, and/or the field generator 126. The instructions may change racket properties to help bring a parameter associated with a user's performance within a predetermined range of values associated with better play.

Other embodiments of the disclosure will be apparent to those skilled in the art from consideration of the specification and practice of the embodiments disclosed herein. It is intended that the specification and examples be considered as exemplary only, with a true scope and spirit of the disclosure being indicated by the following claims and their equivalents.

What is claimed is:

1. A racket assembly, comprising:

a racket including a frame with a handle;

at least one sensor operatively coupled to the handle and configured to generate a signal indicative of at least one parameter related to use of the racket;

a processor mounted on or within the frame, the processor configured to receive the signal as an input, analyze the signal, and determine an output based on the signal; and a communication assembly operatively coupled to the racket and configured to transmit the signal from the at least one sensor to the processor and transmit the output based on the signal to an external electronic device;

wherein the processor includes an electronic analyzer, the electronic analyzer configured to analyze the signal and determine the output based on the signal by applying at least one algorithm.

2. The racket assembly of claim 1, further comprising a memory storage unit configured to store at least one of the signal and the output based on the signal.

3. The racket assembly of claim 1, wherein the communication assembly transmits at least one of the signal and the output based on the signal via a wireless transmission.

4. The racket assembly of claim 1, wherein the communication assembly transmits at least one of the signal and the output based on the signal to the external electronic device via a Universal Serial Bus and plug.

5. The racket assembly of claim 1, wherein the at least one sensor includes an accelerometer configured to generate a signal indicative of racket acceleration.

6. The racket assembly of claim 1, wherein the at least one sensor includes an anemometer configured to generate a signal indicative of a speed of air relative to the racket.

7. The racket assembly of claim 1, wherein the at least one sensor includes a pressure sensor configured to generate a signal indicative of pressure on at least a portion of the racket.

8. The racket assembly of claim 1, wherein the at least one sensor includes a strain sensor configured to generate a signal indicative of strain in at least a portion of the racket.

9. The racket assembly of claim 1, wherein the at least one sensor includes a piezoelectric sensor configured to generate a signal indicative of at least one of vibration levels in the racket.

10. The racket assembly of claim 1, wherein the processor is mounted on the frame.

11. The racket assembly of claim 1, wherein the processor is mounted within the frame.

12. The racket assembly of claim 1, wherein the processor is mounted within the handle.

13. The racket assembly of claim 1, wherein the communication assembly is incorporated into a material used to form the frame.

14. The racket assembly of claim 1, wherein the communication assembly is integrated into the at least one sensor.

15. The racket assembly of claim 1, wherein the communication assembly is integrated into the processor.

16. The racket assembly of claim 1, wherein the processor includes a microcontroller operatively coupled the electronic analyzer, the microcontroller configured to automatically correct and calibrate the signal and the output based on the signal.

17. The racket assembly of claim 1, wherein the processor is configured to compare the output with other data.

18. The racket assembly of claim 1, wherein the processor is operatively coupled to an adjustment assembly configured to change one or more physical properties of the racket based on the signal or the output based on the signal.

19. The racket assembly of claim 18, wherein the adjustment assembly is configured to change a tension in strings of the racket.

20. The racket assembly of claim 18, wherein the adjustment assembly is configured to make the racket stiffer.

21. The racket assembly of claim 18, wherein the adjustment assembly is configured to change a balance point of the racket.

22. A system, comprising:

a racket, the racket including:

a frame with a handle;

at least one sensor operatively coupled to the frame and configured to generate a signal indicative of at least one parameter related to use of the racket;

a first communication device operatively coupled to the racket and configured to transmit the signal; and an electronic device separate from the racket, the electronic device including:

a second communication device for receiving the signal transmitted by the first communication assembly collected during use of a racket;

a processor for analyzing the signal and determining one or more values based on the signal collected during use of the racket; and a memory storage unit configured to store at least one of the signal and the one or more values based on the signal;

wherein the electronic device is configured to display a performance comparison with another player or a predetermined ideal based on at least one of the signal and the one or more values based on the signal.

23. The system of claim 22, wherein the first communication device transmits the signal to the second communication device wirelessly.

24. The system of claim 22, wherein the first communication device transmits the signal to the second communication device via a Universal Serial Bus and plug.

25. The system of claim 22, wherein the racket further comprises a memory storage unit configured to store the signal.

26. The system of claim 22, wherein the at least one sensor includes an accelerometer configured to generate a signal indicative of racket acceleration.

27. The system of claim 22, wherein the at least one sensor includes an anemometer configured to generate a signal indicative of a speed of air relative to the racket.

28. The system of claim 22, further comprising at least one grommet; and wherein the at least one sensor includes a pressure sensor positioned in contact with the at least one grommet, the pressure sensor configured to generate a signal indicative of pressure on at least a portion of the racket.

29. The system of claim 22, wherein the at least one sensor includes a strain sensor configured to generate a signal indicative of strain in at least a portion of the racket.

30. The system of claim 22, wherein the at least one sensor includes a piezoelectric sensor configured to generate a signal indicative of at least one of vibration levels in the racket.

* * * * *